US010435874B2

(12) United States Patent
Rachapudi et al.

(10) Patent No.: US 10,435,874 B2
(45) Date of Patent: Oct. 8, 2019

(54) SYSTEM AND A METHOD FOR OPTIMIZING THE USAGE OF WATER AND OTHER RESOURCES IN RESIDENTIAL AND COMMERCIAL APPLICATIONS

(71) Applicants: Vamsi Krishna Rachapudi, San Jose, CA (US); Hara Gopala Rau Rachapudi, Hyderabad (IN); Karan Kumar Eyunni, Hyderabad (IN)

(72) Inventors: Vamsi Krishna Rachapudi, San Jose, CA (US); Hara Gopala Rau Rachapudi, Hyderabad (IN); Karan Kumar Eyunni, Hyderabad (IN)

( * ) Notice: Subject to any disclaimer, the term of this patent is extended or adjusted under 35 U.S.C. 154(b) by 57 days.

(21) Appl. No.: 15/758,439

(22) PCT Filed: Sep. 9, 2016

(86) PCT No.: PCT/IB2016/055379

§ 371 (c)(1),
(2) Date: Mar. 8, 2018

(87) PCT Pub. No.: WO2017/042724

PCT Pub. Date: Mar. 16, 2017

(65) Prior Publication Data

US 2018/0258622 A1 Sep. 13, 2018

(51) Int. Cl.

| | |
|---|---|
| ***E03C 1/046*** | (2006.01) |
| ***E03C 1/04*** | (2006.01) |
| ***E03C 1/05*** | (2006.01) |

(52) U.S. Cl.
CPC ..... *E03C 1/046* (2013.01); *E03C 1/0408* (2013.01); *E03C 1/055* (2013.01)

(58) Field of Classification Search
CPC ..... E03C 1/046; E03C 1/0408; E03C 1/055
USPC ..... 4/570
See application file for complete search history.

(56) References Cited

U.S. PATENT DOCUMENTS

| | | | | |
|---|---|---|---|---|
| 4,965,894 | A * | 10/1990 | Baus | E03C 1/046 239/305 |
| 9,982,420 | B1 * | 5/2018 | Romaine | E03C 1/055 |
| 2008/0000997 | A1 * | 1/2008 | Smith | E03C 1/0408 236/12.1 |
| 2009/0000024 | A1 * | 1/2009 | Louis | E03C 1/046 4/676 |
| 2014/0143948 | A1 * | 5/2014 | Cochart | E03C 1/046 4/676 |
| 2018/0148912 | A1 * | 5/2018 | Park | E03C 1/05 |
| 2019/0060926 | A1 * | 2/2019 | Benitez | B05B 7/0408 |

* cited by examiner

*Primary Examiner* — Huyen D Le
(74) *Attorney, Agent, or Firm* — KA Filing LLC; Wayne V. Harper

(57) ABSTRACT

The present invention is to optimize the usage of water used by almost all individuals while having a shower. The proposed system uses a timed control for regulating the usage of water and other resources. The system is suitable for residential or commercial applications wherein optimization in usage of water and other resources is desired.

9 Claims, 5 Drawing Sheets

SYSTEM AND A METHOD FOR OPTIMIZING THE USAGE OF WATER AND OTHER RESOURCES IN RESIDENTIAL AND COMMERCIAL APPLICATIONS

TECHNICAL FIELD OF THE INVENTION

The present invention relates to water flow control systems incorporating automation for user's usage preferences. More particularly, it is concerned with battery-operated flow control systems wherein flow of water is controlled by solenoid valves powered by batteries.

BACKGROUND OF THE INVENTION

Due to uncontrolled usage of water by humans and mechanies, there exists a short fall and increased demand for water for utilities in day to day life. There is a need for optimizing the usage of water and also there exists a requirement to conserve water and other resources within our reach. In addition, there is significant damage to the environment due to excessive use of chemical cleansers which flow into the ecosystem thru the drainage. There is a need to minimize the wasted runoff of these chemicals as well.

There are measures taken by governments to reduce wastage of water in households and commercial premises by monitoring the usage habits of the users to restrict them from wasting of these valuable resources. Consumers are made aware of the benefits of control systems that could be leveraged to reduce their water usage.

Alternative solutions including use of timers fitted to the running taps to regulate the flow of water coming from the heads are employed. These systems proved ineffective when we take an example of controllers fitted to heads to reduce water consumption. Additionally, gallons of water are wasted daily by running taps due to non-availability of easy to use control systems.

An important design requirement for battery-operated flow control systems is to achieve power saving to ensure that the batteries last without replacement for a sufficiently long time of use.

It is also required that they can be readily installed in houses or buildings without requiring electric wiring to the commercial power lines.

BRIEF SUMMARY OF THE INVENTION

Accordingly, it is an object of the present invention to provide a new, unobvious, and highly effective and reliable device, design and method, which overcomes the deficiencies of the prior art as described above.

A principal object of the present invention is to optimize the usage of water and other associated resources in residential and commercial applications where there is a need to restrict the consumption of water and educate the individuals through electronic means to track their usage.

According to a first aspect of present invention, a system comprises an inlet pipe extended out from a housing of the system coupled to an outlet pipe of an adjustably opened regular valve to allow water. A pressure gauge to ascertain the pressure of incoming water and temperate gauge to ascertain the temperature of the incoming water are disclosed.

The system further comprises a battery, a turbine placed after the pressure gauge for producing electricity to recharge the battery, an electronic controller device and a chipset for storing user preferences and to communicate with external device(s) for the purposes of tracking usage patterns and measuring fluid levels. The system further comprises plurality of refillable dispensers for storing fluids used. The system also has plurality of timer controlled valve elements, preferably solenoid valves to regulate the flow of water to an outlet pipe.

The system comprises a switch board with a plurality of push switches to enable the user select his/her usage preferences, and/or manually select to have a preferred usage and a plurality of indicators notifying the user's preferences, a start and stop position of a preferred usage.

The system further comprises the valve elements controlled by the controller device to optimize the usage of water. The refillable dispensers stores one or more associated resources used in the preferred usage.

The system comprises an electronic controller device that guides timer control valves for selectively adjusting predetermined period of times of their operations and a switch board to select a preferred usage includes water temperature, a fluid or fresh water and/or a next cycle. The electronic controller device powers the timer controlled valves to allow water to pass through the inlet, goes through the controls and flow directly out to the outlet pipe.

According to a second aspect of present invention, a method for optimizing the usage of water and other associated resources used in preferred usage is disclosed. The method comprises steps of connecting an outlet pipe to an inlet pipe extended out from a housing of a controller system.

The controller system comprises a pressure gauge fixed to the inlet pipe to ascertain a pressure of the incoming water and a temperature gauge to the inlet pipe to ascertain the temperature of incoming water. A turbine is placed after the pressure gauge for producing electricity to recharge a battery, an electronic controller device and a chipset for storing user preferences and to communicate with external device(s) for the purposes of tracking usage patterns, and measuring fluid levels.

The controller system also comprises a plurality of refillable dispensers for storing fluids used, a plurality of timer controlled valve elements, preferably solenoid valves to regulate the flow of water to an outlet pipe.

The method also comprises steps of selecting user preferences on a switch board with a plurality of push switches to enable the user to select a desired bath and the valve elements are controlled by the controller device causing the valves operated to be opened and/or closed at predetermined time periods.

BRIEF DESCRIPTION OF THE DRAWINGS

Other objects and advantages of the present invention will become apparent to those skilled in the art upon reading the following detailed description of the preferred embodiments, in conjunction with the accompanying drawings, wherein like reference numerals have been used to designate like elements, and wherein.

DETAILED DESCRIPTION OF THE INVENTION

Figure 1:
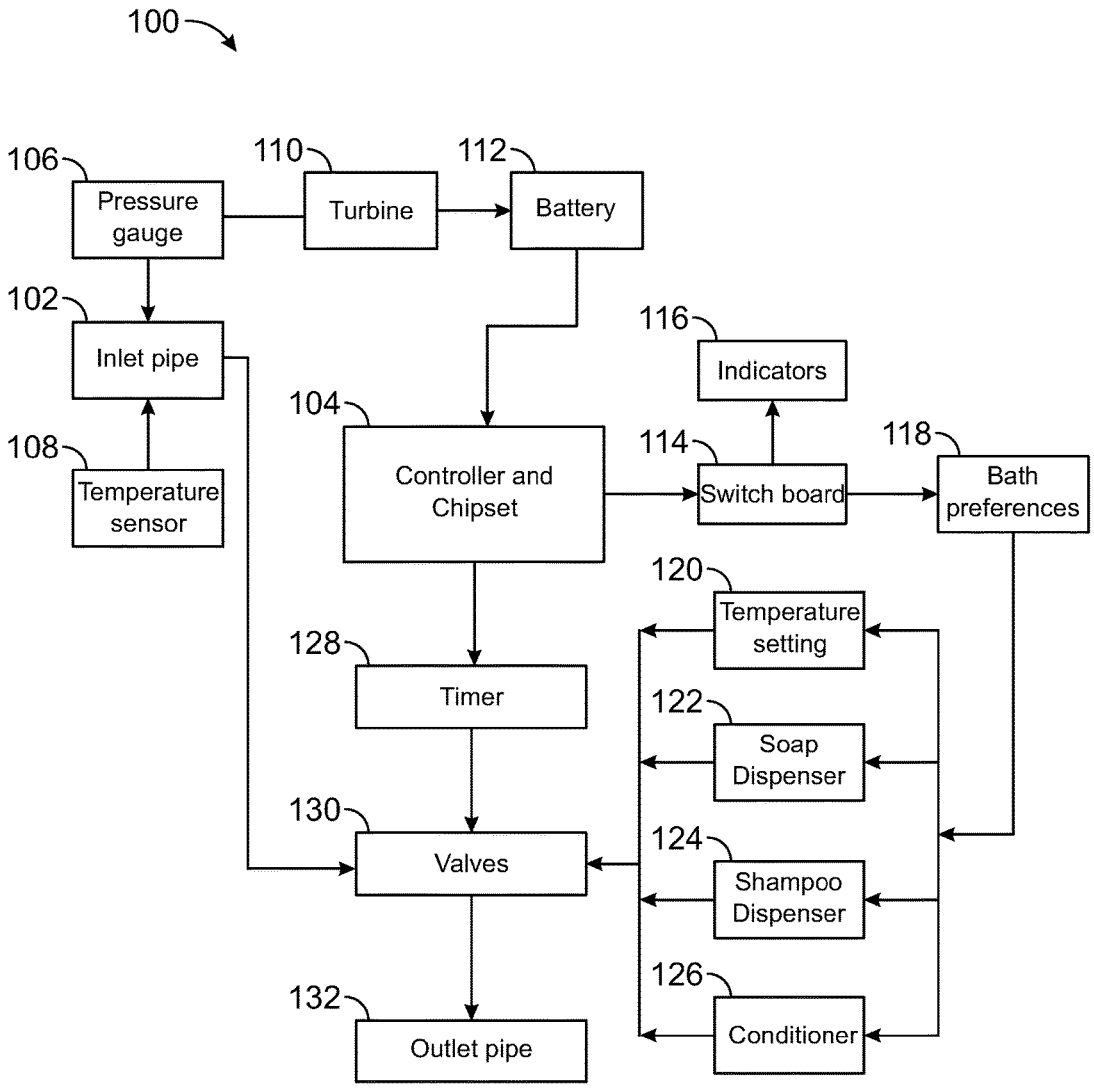
FIG. 1 illustrates a block diagram depicting an exemplary embodiment for optimizing the usage of water, cleansers and other resources in a shower bath according to the present invention.

The present invention is directed towards a system and method for optimizing the usage of water and other resources used in residential and commercial properties. Referring to the drawings, wherein like reference numerals designate identical or corresponding systems, preferred embodiments of the present invention are described.

In accordance with a first exemplary embodiment of the present invention, a system for optimizing the usage of water and other associated resources used in bath showers is disclosed. The system comprises an inlet pipe extended out from a housing of the system coupled to an outlet pipe of an adjustably opened regular valve to allow hot and cold water. A pressure gauge is provided to ascertain the pressure of incoming water and a temperature gauge to ascertain the temperature of the incoming water.

A turbine is placed after the pressure gauge for producing electricity to recharge the battery, an electronic controller device and a chipset for storing user preferences and to communicate with external devices for the purpose of tracking usage patterns and measuring fluid levels and a plurality of refillable dispensers for storing fluids used in shower baths.

The system further comprises valve elements controlled by the controller device to optimize the usage of water. The refillable dispensers store one or more associated resources used in bath showers, includes soap, shampoo and a conditioner or the like. The system comprises an electronic controller device that guides timer control valves for selectively adjusting predetermined period of times of their operations and a switch board to select a preferred bath includes water temperature, a fluid or fresh water and/or a next cycle.

The electronic controller device powers the timer controlled valves to allow water to pass through inlet, goes through the controls and flow directly out to the shower outlet pipe and the electronic controller device under consideration allows, by means of its incorporated controls, a considerable efficiency in reducing the water wastage.

In accordance with a second exemplary embodiment of present invention, a method for optimizing the usage of water and other associated resources used in residential and commercial properties is disclosed. The method comprises steps of connecting a shower outlet pipe to an inlet pipe extended out from a housing of a controller system.

The controller system comprises a pressure gauge fixed to the inlet pipe to ascertain a pressure of the incoming water, temperature gauge to the inlet pipe to ascertain the temperature of incoming water, a turbine placed after the pressure gauge for producing electricity to recharge a battery and an electronic controller device and a chipset for storing user preferences and to communicate with external devices for the purpose of tracking usage patterns and measuring fluid levels.

In accordance with the second exemplary embodiment of present invention, the controller system also comprises a plurality of refillable dispensers for storing fluids used in shower baths, a plurality of timer controlled valve elements, preferably solenoid valves to regulate the flow of water to an outlet pipe.

The method comprises steps of selecting bath preferences on a switch board with a plurality of push switches to enable the user to select a desired bath, and the valve elements are controlled by the controller device causing the valves operated to be opened and/or closed at predetermined time periods.

Referring to the drawings, FIG. 1 illustrates a block diagram 100 depicting a shower bath for optimizing the usage of water according to the present invention. The shower bath comprises an inlet pipe 102 extended out from a housing 100 of a control system coupled to an outlet pipe 132 capable of allowing hot and cold water and adjustably opened by regular user adjustable valve. The inlet pipe 102 connected with a pressure gauge 106 and a temperature gauge 108 to determine the pressure and temperature of incoming water. Electricity is generated by a turbine 110 placed after the pressure gauge 106 to recharge a battery 112 to power the system such as controller and chipset 104.

For the user bath preferences 118 a fluid or fresh water and/or next cycle in residential and commercial properties are stored in an electronic controller and chipset 104 and communicate with external devices for the purpose of tracking usage and measuring fluid levels. The plurality of refillable dispensers such as soap dispenser 122, shampoo dispenser 124 and conditioner dispenser 126 are used for shower bath. A temperature setting 120 is included for setting temperature for cold and warm options before timer 128 starts. A plurality of timer 128 controlled valves 130 are used for selectively adjusting based on the predetermined time period of operations of a shower bath are guided by the electronic controller device 104. The timer 128 controls valve elements for regulating the flow of water to an outlet pipe 132 of the shower.

Figure 5:
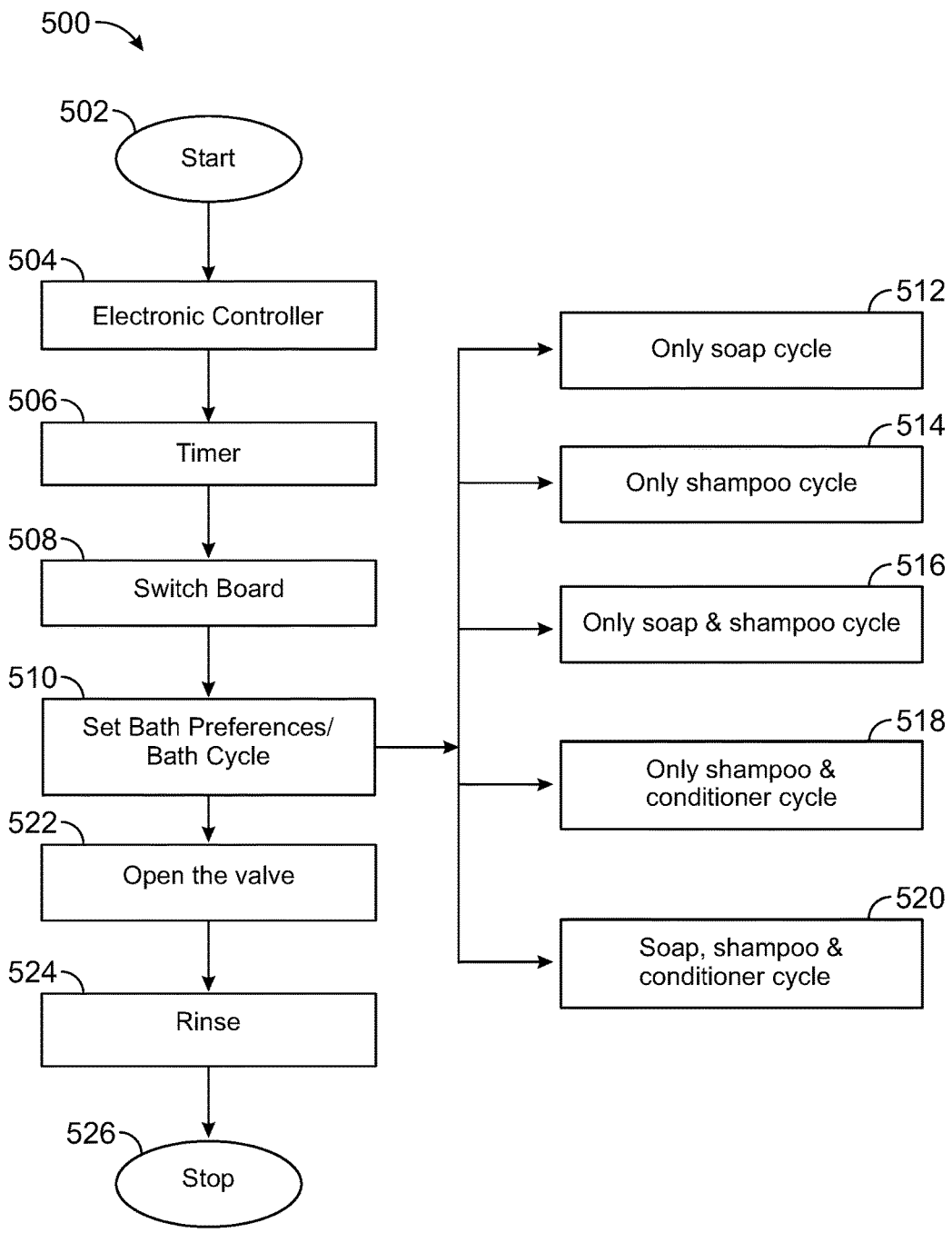
FIG. 5 illustrates a flow chart depicting a step by step process of selecting bath preferences by a user according to the present invention.

A switch board 114 comprising a plurality of push switches are used to select the bath preferences includes water temperature such as a fluid or fresh water and/or a next cycle. The user bath preferences 118 are indicated by the plurality of indicators 116 including a start and a stop position of bath. The electronic controller device 104 powers the timer 128 controller valves 130 to allow water to pass through the inlet 102 for controlling and directly flowing out to the shower outlet pipe 132. The electronic controller device comprises considerable controls and allows a considerable efficiency in electrical energy as well as other forms of energy. The bath preferences selection is shown in FIG. 5.

Figure 2:
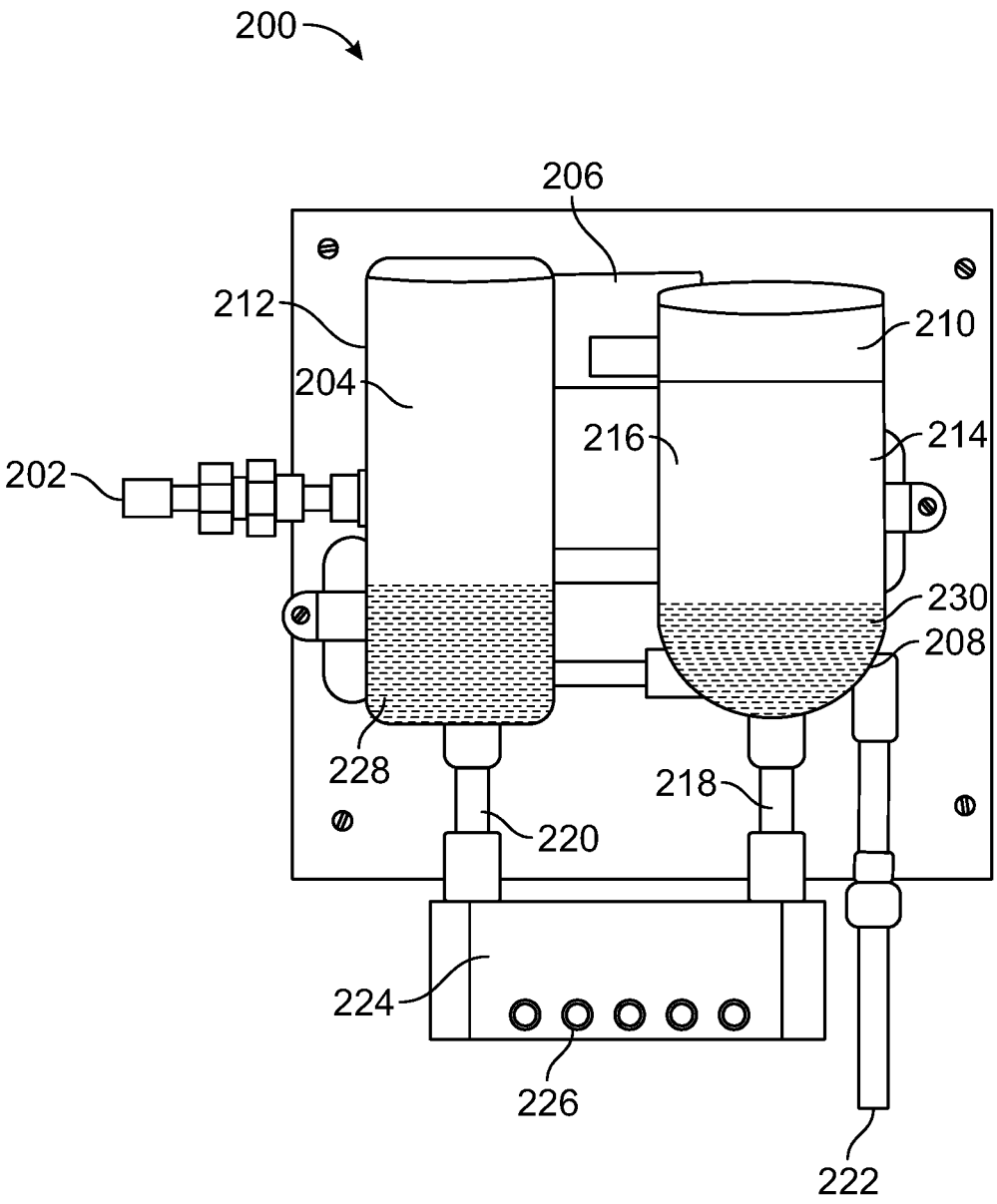
FIG. 2 illustrates a perspective view depicting the exemplary embodiment for optimizing the usage of water, cleansers and other resources in a shower bath according to the present invention.

FIG. 2 illustrates a perspective view 200 depicting a shower bath for optimizing the usage of water according to the present invention. The shower bath comprises an inlet pipe 202 extended out from a housing 200 of a control system coupled to an outlet pipe 222 capable of allowing hot and cold water and adjustably opened regular user adjustable valve. A pressure gauge 204 is fixed to the inlet pipe 202 to determine a pressure of incoming water. A temperature gauge (not shown) is fixed to the inlet pipe to determine the temperature of incoming water. Electricity is generated by a turbine 208 placed after the pressure gauge 204 to recharge a battery 206 powering the system.

The user preferences such as a fluid or fresh water and/or next cycle in residential and commercial properties are stored in an electronic controller (not shown in figure) and a chip set 210 and communicate with external devices for the purpose of tracking usage patterns and measuring fluid levels. A plurality of refillable dispensers for storing one or more associated resources used in residential and commercial properties includes soap 230, a shampoo 228 and a conditioner (not shown in FIG) or the like. A plurality of timer controlled valves are used for selectively adjusting based on the predetermined time period of operations of a shower bath are guided by the electronic controller device. The timer controlled valve elements such as solenoid valves 216, 218 and 220 are used for regulating the flow of water to an outlet pipe of the shower 222.

A switch board 224 comprising a plurality of push switches 226 to select the bath preferences such as water temperature, a fluid or fresh water and/or a next cycle. The user bath preferences are indicated by the plurality of indicators (not shown in FIG) to start and stop position of bath. The electronic controller device powers the timer controller valves such as solenoid valves 216, 218 and 220 to allow water to pass through the inlet 202 for controlling and directly flowing out to the shower outlet pipe 222. The solenoid valves 216, 218 and 220 are controlled by the electronic controller device which operates the valves 216, 218 and 220 to optimize the usage of water. The electronic device also communicate with external device(s), such as smartphones or cloud-based applications for the purposes of tracking usage patterns, and measuring fluid levels, notifying users, etc.

Figure 3:
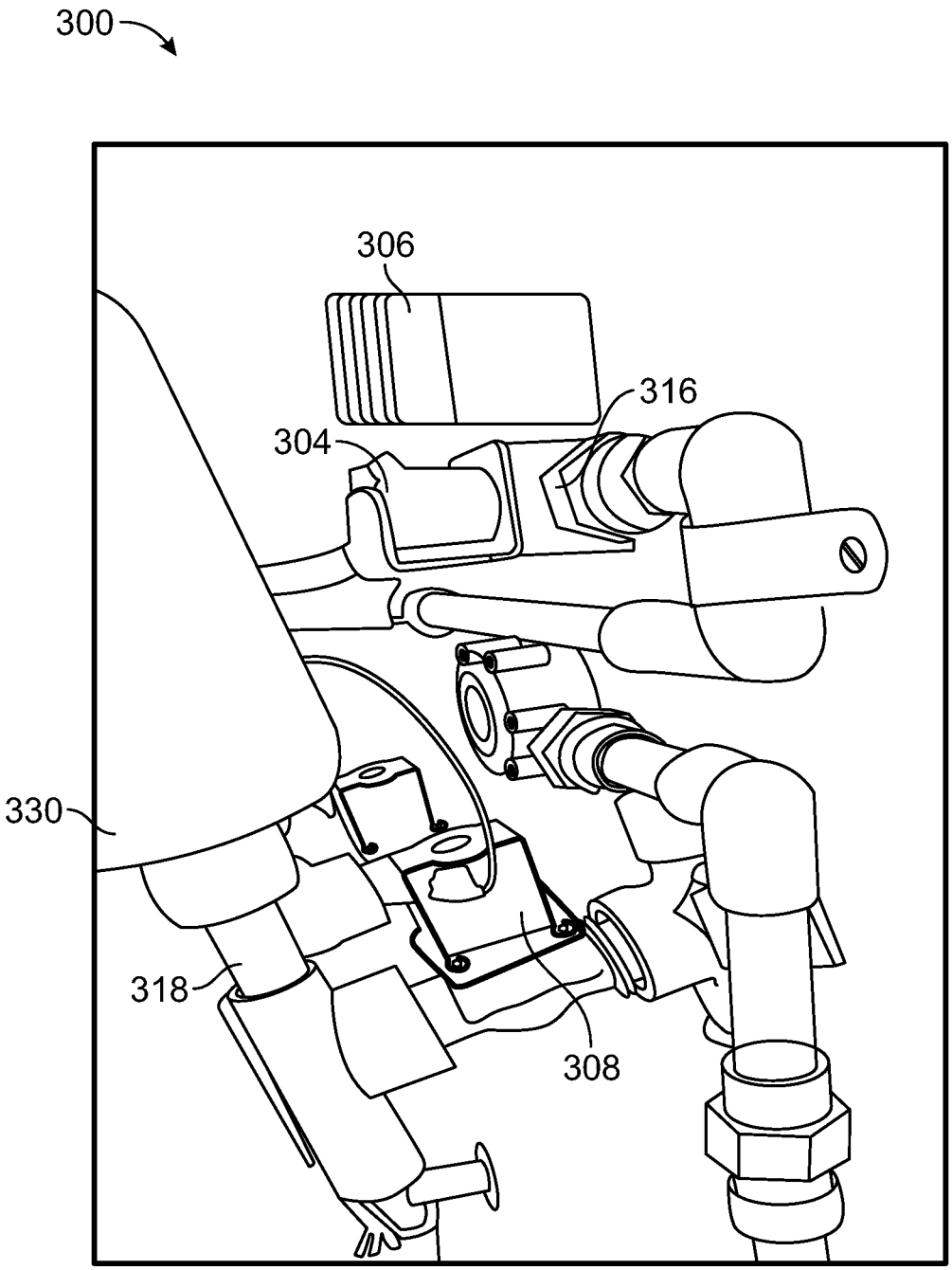
FIG. 3 illustrates a side view depicting the exemplary embodiment for optimizing the usage of water, cleansers and other resources in a shower bath according to the present invention.

FIG. 3 illustrates a side view depicting the water optimizer of shower bath according to the present invention. The pressure gauge 304 is fixed to the inlet pipe 302 (not shown in FIG) to determine the pressure of incoming water. The turbine 308 placed after the pressure gauge 304 is used for producing electricity to recharge the battery 306. The user preferences for selecting the shower are stored in the micro controller and chip set. The timer controlled valves, preferably a plurality of solenoid valves 316, 318 and 320 (not shown in FIG) are used for selectively adjusting the predetermined time period of operations of a shower bath, guided by the electronic controller device as shown in FIG. 1.

Figure 4:
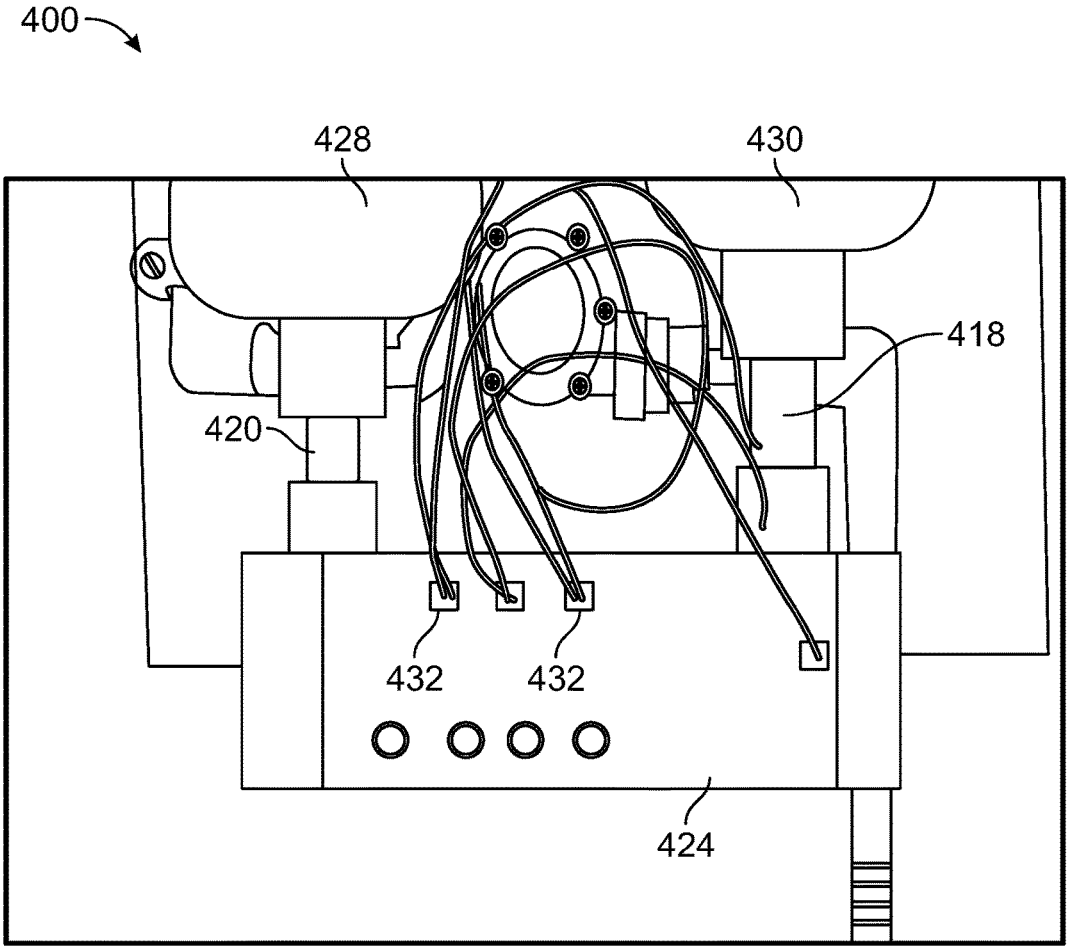
FIG. 4 illustrates a perspective view depicting the switch board of the exemplary embodiment for optimizing the usage of water, cleansers and other resources in a shower bath according to the present invention.

FIG. 4 illustrates a perspective view depicting the switch board of the shower bath according to the present invention. The switch board 424 comprises a plurality of push switches for selecting the bath preferences such as only soap cycles, only shampoo cycles; only soap and shampoo cycles; only shampoo and conditioner cycle; and soap, shampoo and conditioner cycle. Plurality of indicators 432 presented on the switch board 424 are provided to notify the user, the preferences like start and stop of a preferred action.

FIG. 5 illustrates a flow chart 500 depicting a step by step process of selecting bath preferences of user according to the present invention. At the start process 502, electronic controller 504 for storing the user preferences such as fluid or fresh water and/or next cycle. Timer 506 for controlling the solenoid valves to regulate the flow of water to an outlet. A switch board 508 comprises a plurality of push switches for selecting the bath preferences or bath cycles 510. The bath cycles or bath preferences include but not limited to only soap cycle 512, only shampoo cycle 514, only soap and shampoo cycle 516.

If in an embodiment, the shower bath as shown in FIG.1 employs a conditioner dispense then the preferable bath cycles also include only shampoo and conditioner cycle 518 and soap, shampoo and conditioner cycle 520. The valve elements are opened 522 to optimize the usage of water and the user is rinsed 524 with the selected bath at the stop process 426.

In an embodiment, the shower bath comprises of two or more refillable dispensers to accommodate a conditioner or the like, retaining the working of the system as described above. Other components such as solenoid valves, pressure gauge, battery etc., are replaceable with suitable components without departing from the scope of the invention as defined in the accompanying claims.

The detailed description of the above embodiment of the invention is only for ease of understanding and cited examples should not be construed as limiting the scope of the invention. Any person skilled in the art will appreciate that various modifications, additions and substitutions are possible, without departing from the scope and spirit of the invention as disclosed in the accompanying claims.

We claim:

1. A system for optimizing the usage of water and other associated resources used, wherein the system comprises of:
- an inlet pipe extended out from a housing of the system coupled to an outlet pipe of an adjustably opened regular valve to allow water;
- a pressure gauge, to ascertain the pressure of incoming water;
- a temperature sensor, to ascertain the temperature of incoming water;
- a battery, a turbine placed after the pressure gauge for producing electricity to recharge the battery;
- an electronic controller device and a chipset for storing user preferences and to communicate with external device(s) for the purposes of tracking usage patterns, and measuring fluid levels;
- a plurality of refillable dispensers for storing fluids used in user's preferences;
- a plurality of timer controlled valve elements to regulate the flow of water to a outlet pipe;
- a switch board with a plurality of push switches to enable the user's preferences, or manually select to use;
- a plurality of indicators notifying the users preferences, a start and stop position of a preference;
- the valve elements controlled by the controller device operates the valves to optimize the usage of water; and
- a timer, to create a measurable and significant delay between the user's preferences, thus preventing a user from starting back-to-back cycles and preventing further wastage of water and associated resources.

2. The system according to claim 1, wherein the electronic controller device guides timer control valves for selectively adjusting predetermined period of times of their operations.

3. The system according to claim 1, wherein said indicators notifying the users preferences are light emitting diodes in the visible spectrum.

4. The system according to claim 1, wherein said timer controlled valve elements consists of at least one solenoid actuated valve means having a pair of operating terminals connected to an output terminal of said timer means, and a source of reference potential, respectively.

5. The system according to claim 1, wherein the switch board is used to select a preferred usage including water temperature, a fluid or fresh water and/or a next cycle.

6. The system according to claim 1, wherein the electronic controller device powers the timer controlled valves to allow water to pass through the inlet, goes through the controls, flowing directly out to the shower outlet pipe.

7. The system according to claim 1, wherein comprises of a DC voltage level detecting means.

8. The system according to claim 1, wherein the electronic controller device under consideration allows, by means of its incorporated controls, a considerable efficiency and electrical energy as well as other forms of energy.

9. A method for optimizing the usage of water and other associated resources used, wherein the method comprises steps of:

connecting, an outlet pipe to an inlet pipe extended out from a housing of a controller system, comprising:

a pressure gauge fixed to the inlet pipe to ascertain a pressure of the incoming water;

a temperature gauge to the inlet pipe to ascertain the temperature of incoming water;

a turbine placed after the pressure gauge for producing electricity to recharge a battery;

an electronic controller device and a chipset for storing user preferences and to communicate with external device(s) for the purposes of tracking usage patterns, and measuring fluid levels;

a plurality of refillable dispensers for storing fluids used;

a plurality of timer controlled valve elements, preferably solenoid valves to regulate the flow of water to a outlet pipe;

and selecting, user preferences on a switch board with a plurality of push switches to enable the user to use; and the valve elements controlled by the controller device causing the valves operated to be opened and/or closed at predetermined time periods.

* * * * *